United States Patent [19]

Kojima et al.

[11] Patent Number: 4,778,107

[45] Date of Patent: Oct. 18, 1988

[54] FUEL INJECTION VALVE ASSEMBLY AND AN ASSEMBLING METHOD THEREFOR

[75] Inventors: Fumio Kojima, Chiryu; Tateshi Katho, Anjo; Tomihiko Nagata, Oobu; Sadao Sumiya, Takahama; Shinzo Ito, Aichi; Takumi Noma, Okazaki; Takashi Hieda, Nagoya, all of Japan

[73] Assignee: Nippondenso Co., Ltd., Kariya, Japan

[21] Appl. No.: 82,090

[22] Filed: Aug. 5, 1987

[30] Foreign Application Priority Data

Aug. 21, 1986 [JP] Japan ..... 61-196315
Jun. 22, 1987 [JP] Japan ..... 62-155018

[51] Int. Cl.[4] ..... B05B 17/00

[52] U.S. Cl. ..... 239/1; 239/76; 73/196

[58] Field of Search ..... 73/195, 196; 239/11, 239/71, 76, 585, 533.3–533.9, 600, 552, 596

[56] References Cited

U.S. PATENT DOCUMENTS 2,757,961 8/1956 Nims ..... 239/76
3,435,837 4/1969 Sher ..... 73/196
3,810,581 5/1974 Rhine ..... 239/533.9 X
4,506,833 3/1985 Yoneda et al. ..... 239/533.4

FOREIGN PATENT DOCUMENTS 379453 8/1923 Fed. Rep. of Germany .
3633612 4/1987 Fed. Rep. of Germany .
61-97584 6/1986 Japan .
61-272460 12/1986 Japan .
400836 11/1933 United Kingdom .
2082292 3/1982 United Kingdom .

*Primary Examiner*—Andres Kashnikow
*Assistant Examiner*—Kevin Patrick Weldon
*Attorney, Agent, or Firm*—Cushman, Darby & Cushman

[57] ABSTRACT

An assembling method of a fuel injection valve for fuel injection into an internal combustion engine, the fuel injection valve including a cylindrical valve body having a fuel passage therein and a through-hole made in a direction of the axis thereof and a cylindrical nozzle coupled to the valve body and having a plurality of injection holes for dividing the fuel exited from the through-hole into a plurality of parts and for injecting the divided fuel parts into the engine. The assembling method comprises the steps of coupling the nozzle to the valve body, rotating the valve body relative to the nozzle, and stopping the rotation of the valve body when the through-hole takes a desirable position relative to the injection holes and fixedly securing the nozzle to the valve body. Preferably, an end portion of the valve body is tapered conically and the nozzle has at least one edge portion at its inside so that the edge portion comes into contact with the tapered portion when the nozzle is coupled to the valve body, the edge portion being made of a material whcih is deformed non-elastically in response to application of a force. The edge portion is crushed flat when the nozzle is coupled to the valve body.

6 Claims, 7 Drawing Sheets

FUEL INJECTION VALVE ASSEMBLY AND AN ASSEMBLING METHOD THEREFOR

BACKGROUND OF THE INVENTION

The present invention relates generally to a fuel injection valve assembly and an assembling method therefor, and is applicable particularly, but not exclusively, to fuel injection into an internal combustion engine of a motor vehicle.

It is known in the fuel injection art that a fuel injection valve is arranged to have two injection holes in the case that the fuel injection valve is applied to fuel injection into a four-valve internal combustion engine with two intake valves per one cylinder. Such a fuel injection valve is illustrated, for example, in "JOURNAL OF NIPPONDENSO TECHNICAL DISCLOSURE" No. 33-065, published in 1984, wherein installed at the lower portion of the fuel injection valve is a cylindrical body having a through-hole at its center portion which is in turn coupled to a nozzle having two injection holes whereby the fuel exited from the through-hole is divided into two directions. Each of the two injection holes is directed to the corresponding one of two intake valves of the engine so as to prevent the injected fuel from striking the intermidiate portion between the two intake valves.

However, in such an arrangement to divide the fuel into a plurality of directions by means of a plurality of injection holes, the fuel injection valve is required to be finished with considerably high accuracy, particularly in terms of the diameter and axis of each of the injection holes. The irreguralities and variations thereamong causes variations in the amounts of fuel injected from the injection holes, resulting in poor responsibility and poor emission. The high manufacturing accuracy would be costly and troublesome. One attempt to relaxation of the high manufacturing accuracy involves providing a considerably great space between the cylindrical body and the nozzle. This has a great disadvantage, however, in that fuel remains in the space, resulting in the occurrance of a poor fuel/air mixture.

SUMMARY OF THE INVENTION

It is therefore an object of the present invention to provide a technique which is capable of eliminating the variation in the injection amounts of fuel from the respective injection holes irrespective of relatively low manufacturing accuracy.

Another object of the present invention is to provide a new and improved fuel injection valve assembly wherein a valve body is stably coupled to a nozzle.

In accordance with the present invention, there is provided a fuel injection valve assembly for fuel injection into an internal combustion engine comprising a cylindrical valve body having a fuel passage therein and a through-hole made in a direction of the axis thereof, a needle provided in the fuel passage of the valve body for controlling a flow rate of fuel from the fuel passage by opening and closing the through-hole, and a cylindrical nozzle coupled to the valve body so that the through-hole is covered from the outside of the valve body, the nozzle having a plurality of injection holes for dividing the fuel exited from the through-hole into a plurality of parts and for injecting the divided fuel parts into the engine, wherein an end portion of the valve body is tapered conically and the nozzle has at least one edge portion at its inside so that the edge portion comes into contact with the tapered portion when the nozzle is coupled to the valve body, the edge portion being deformed non-elastically against the tapered portion when a force is applied to the nozzle for the coupling of the nozzle and the valve body.

In accordance with the present invention, there is further provided an assembling method of a fuel injection valve for fuel injection into an internal combustion engine which includes a cylindrical valve body having a fuel passage therein and a through-hole made in a direction of the axis thereof, a needle provided in the fuel passage of the valve body for controlling a flow rate of fuel from the fuel passage by opening and closing the through-hole, and a cylindrical nozzle coupled to the valve body so that the through-hole is covered from the outside of the valve body, the nozzle having a plurality of injection holes for dividing the fuel exited from the through-hole into a plurality of parts and for injecting the divided fuel parts into the engine, comprising the steps of: (a) coupling said nozzle to the valve body; (b) rotating the valve body relative to the nozzle; and (c) stopping the rotation of the valve body when the through-hole takes a desirable position relative to the injection holes and fixedly securing the nozzle to the valve body.

Preferably, a light source is provided for projecting light from the upstream side of the through-hole with the valve body being rotated relative to the nozzle, and the valve body is stopped when the ratio of amounts of light rays passed through the injection holes assumes a predetemined value. In this case, the position arrangement of the valve body and the nozzle can be easily effected using microcomputer which computes the ratio of the light amounts and stops the rotation of the valve body when the light amount ratio assumes a predetermined value. This is based on the fact that the light amount ratio corresponds to the ratio of actual flow rates of fuel.

In accordance with the present invention, there is still further provided an assembling method of a fuel injection valve for fuel injection into an internal combustion engine which includes a cylindrical valve body having a fuel passage therein and a through-hole made in a direction of the axis thereof, a needle provided in the fuel passage of the valve body for controlling a flow rate of fuel from the fuel passage by opening and closing the through-hole, and a cylindrical nozzle coupled to the valve body so that the through-hole is covered from the outside of the valve body, the nozzle having a plurality of injection holes for dividing the fuel exited from the through-hole into a plurality of parts and for injecting the divided fuel parts into the engine, comprising the steps of: (a) coupling the nozzle to the valve body; (b) projecting light from the upstream side of the through-hole; (c) rotating the valve body relative to the nozzle at intervals of a predetermined angle; (d) stopping the rotation of the valve body whenever the valve body is rotated by the predetermined angle and measuring the ratio of amounts of the light rays passed through the injection holes; (e) determining an optimum angle of the rotation angles at which the relation in position between the through-hole and the injection holes becomes desired when the valve body is rotated through 360°; (f) further rotating the valve body to the optimum angle; and (g) fixedly securing said nozzle to said body after reaching said optimum angle.

Preferably, the rotation of the valve body is performed with the edge being deformed by pressing it the tapered portion when the nozzle is coupled to the valve body. This can provide a smooth rotation of the valve body because the edge portion of the nozzle can come into surface contact with the tapered portion of the valve body, resulting in easy and accuracte position adjustment.

BRIEF DESCRIPTION OF THE DRAWINGS

The object and features of the present invention will become more readily apparent from the following detailed description of the preferred embodiments taken in conjunction with the accompanying drawings in which.

DETAILED DESCRIPTION OF THE INVENTION

Figure 1:
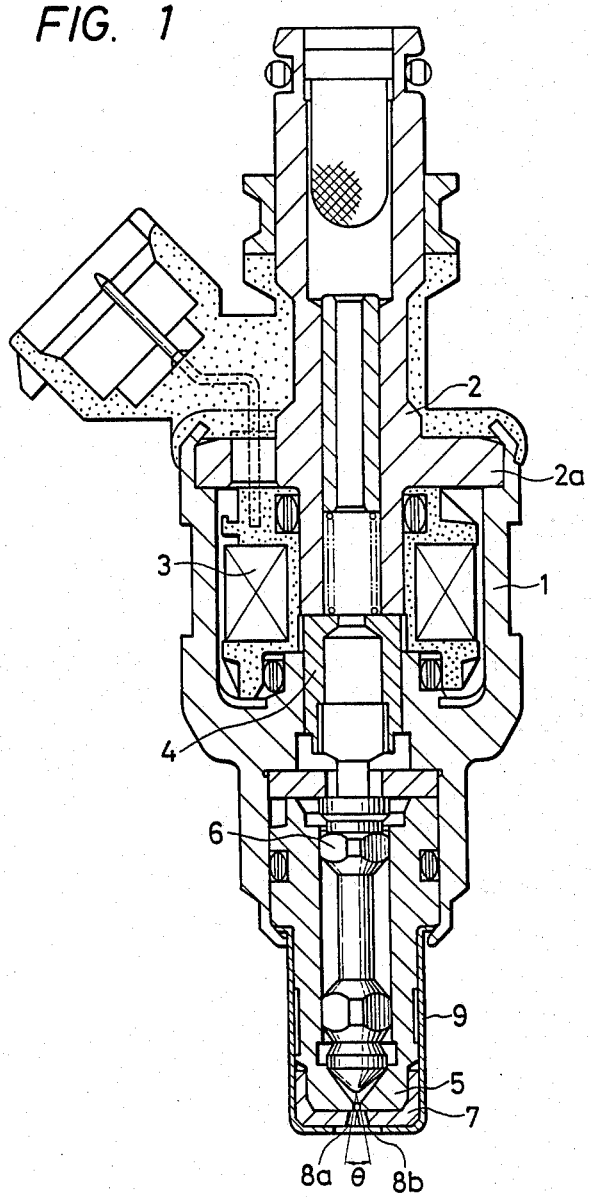
FIG. 1 is is a cross-sectional view showing a fuel injection valve assembly according to an enbodiment of the present invention.
Figure 2:
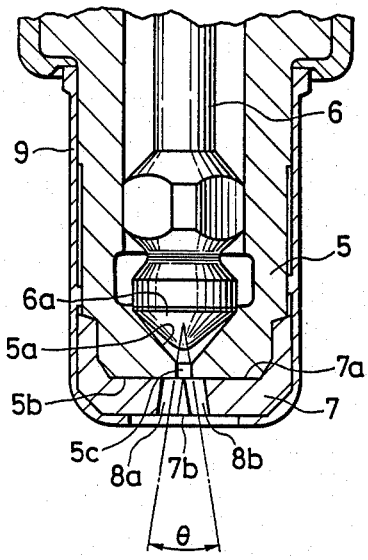
FIG. 2 is is an enlarged illustration of the end portion of the FIG. 1 fuel injection valve assembly.

Referring now to FIG. 1, there is illustrated a fuel injection valve assembly according to an embodiment of the present invention which is shown as comprising a valve body 5 fixedly secured, at one end portion, to the lower portion of a housing 1 which encases a fixed core 2 with a flange portion 2*a*, an electromagnetic coil 3 placed at the circumference of the fixed core 2 and below the flange portion 2*a*, and a movable core 4 movable in the axis directions of the fuel injection valve assembly. The valve body 5 has a cylindrical configuration to receive, in its inside, a needle 6 which is connected to the movable core 4 and slidable along the inner wall of the valve body 5 in response to energization of the electromagnetic coil 3. The other end portion of the valve body 5 is coupled to a nozzle 7 having injection holes 8*a* and 8*b* through which fuel is injected toward the intake pipes, not shown. The valve body 5 and the nozzle are covered by a sleeve 9 having the heat insulation effect. FIG. 2 is an enlarged illustration of the end portion of the fuel injection valve assembly including the valve body 5 and the nozzle 7. As seen from FIG. 2, the end portion 6*a* of the needle 6 which has a substantially conical configuration and whose sharp end is rounded is arranged so as to be brought into contact with the surface 5*a* of a portion conically formed at the inside of the valve body 5 or to be separated therefrom in accordance with the energization or deenergization of the electromagnetic coil 3 whereby the flow-out of the fuel in the valve body 5 is cut off or made. The outer end surface 5*b* of the valve body 5 is circular and flat in configuration and a through-hole 5*c* is made at the center portion thereof in the axis direction of the fuel injection valve assembly so that the inside of the valve body 5 communicates with the outside thereof. The through-hole 5*c* acts as a restriction of the fuel in the valve body 5. The nozzle 7 has also a cylindrical configuration, one end of which is opened and the other end of which is closed. The closed inner end surface 7*a* has the same configuration as the outer end surface 5*b* of the valve body 5 so that the end portion of the valve body 5 can be coupled to the nozzle 7 with the closed end inner surface 7*a* thereof being fitted tightly with the outer end surface 5*b* thereof. The injection holes 8*a* and 8*b* equal in diameter (for example, about 0.8 mm) greater than that of the through-hole 5*c* are defined at the center portion of the end inner surface 7*a* so that the axes thereof are directed to two directions from the inner end surface 7*a* to make an angle of $\theta$ to one another. That is, the two injection holes 8*a* and 8*b* are overlapped at their inlets, i.e., at the inner end surface 7*a*, and are completely separated, or branched, from each other on the way to their outlets by means of a partition 7*b* provided therebetween.

Here, operation of the fuel injection valve assembly with above-mentioned arrangement will briefly be described hereinbelow. In response to supply of an inection signal from a microcomputer, not shown, to the electromagnetic coil 3, the electromagnetic coil 3 is energized to produce an electromagnetic force so that the movable core 4 is sucked toward the fixed core 2. As a result, the end portion 6*a* of the needle 6 connected to the movable core 4 is lifted to be separated from the conical surface 5*a* of the valve body 5 and therefore fuel is exited from the inside of the valve body 5 through the through-hole 5*c* to the nozzle 7 where the fuel is divided by the injection holes 8*a*, 8*b* into the two directions and injected into intake pipes, not shown, positioned at the outside thereof.

Figure 3:
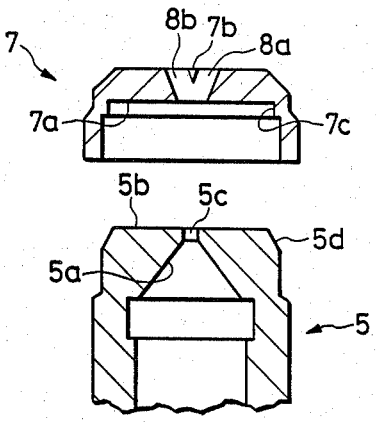
FIG. 3 is an exploded view of a valve body and a nozzle of the FIG. 2 fuel injection valve assembly.
Figure 4A:
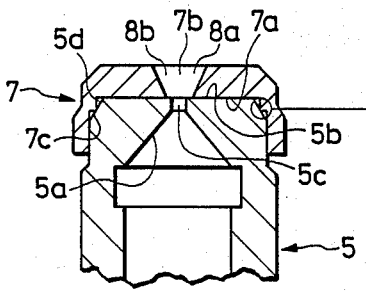
FIG. 4A shows the state that the nozzle and valve body are assembled.
Figure 4B:
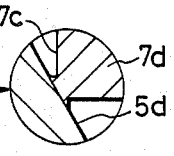
FIG. 4B is a partially enlarged view showing the state an edge is crushed flat by pressure contact with a tapered portion of the valve body.
Figure 5A:
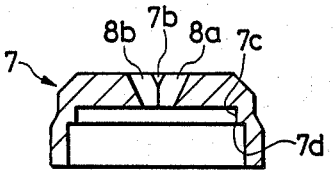
FIGS. 5A through 5D are respectively illustrations for describing arrangements of the edge.
Figure 5C:
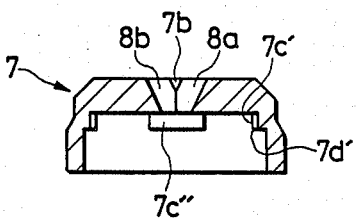
Figure 5B:
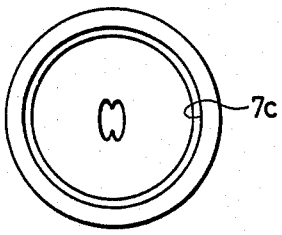
Figure 5D:
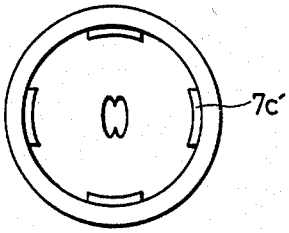

A further detailed description of the fuel injection valve will herein below be made with reference to FIG. 3 which is an exploded view of the valve body 5 and the nozzle 7. In FIG. 3, the through-hole 5*c* is made to have a diameter (for example, about 0.41 mm) for allowing a predetemined flow rate when fuel actually flows out through the through-hole 5*c* and the circular edge of the end portion of the valve body 5 is tapered conically to make a tapered portion 5*d*. On the other hand, the nozzle 7 has a raised, or convexed, portion 7*c* formed at the conner between the inner end surface 7*a* and the cylindrical surface and the convexed portion 7*c* has an edge 7*d* which comes into contact with the tapered portion 5*d* of the valve body 5 on assembly. This arrangement is substantially similar to an arrangement in which a ring having a square cross-section is fitted at the corner portion of a cylindrical member one end of which is covered by a circular and flat plate, before fixed thereto. The convexed portion 7*c* is made of a material which is deformed non-elastically to some degree when a force is applied thereto, and therefore the edge 7*d* of the convexed portion 7*c* is crushed flat against the tapered portion 5*d* in response to the application of the force on assembly of the nozzle 7 and the valve body 5, as described in FIG. 4B which is an enlarged view showing the state that the edge 7*d* is crushed flat by pressure contact with the tapered portion 5*d* of the valve body 5, FIG. 4A showing the state that the nozzle 7 and the valve body 5 are assembled. The valve body 5 and the nozzle 7 are in surface contact with each other and becomes in the stable assembling state. Here, the dimension of the convexed portion 7*c* is determined so that the space between the outer end surface 5*b* of the valve body 5 and the inner end surface 7*a* of the nozzle 7 becomes extremely small (below several micrometers) to prevent fuel from remaining therein. Although on the plastic deformation of the edge 7*d* the space therebetween temporarily becomes zero, the space will be formed in response to removal of the applying force. While the convexed portion 7*c* is formed circumferentially at the entire corner of the nozzle 7 as shown in FIGS. 5A and 5B which are a cross-sectional view and a plan view of the nozzle 7, it is also appropriate that a plurality of convexed short portions 7*c*' obtained by division of the convexed portion 7*c* are provided at equal intervals at the corner of the nozzle 7 as shown in FIGS. 5C and 5D which are a cross-sectional view and a plan view thereof. If the plurality of convexed short portion 7*c*' are used, it is possible to reduce the magnitude of force applied thereto to crush edges 7*d*' flat.

Figure 6A:
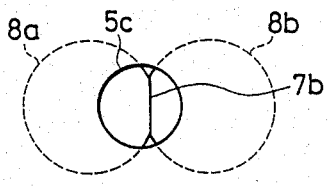
FIGS. 6A through 6D are illustration useful for describing the principle of a position adjusting method for the nozzle and the valve body.
Figure 6B:
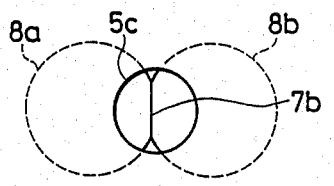
Figure 6C:
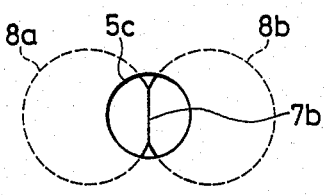
Figure 6D:
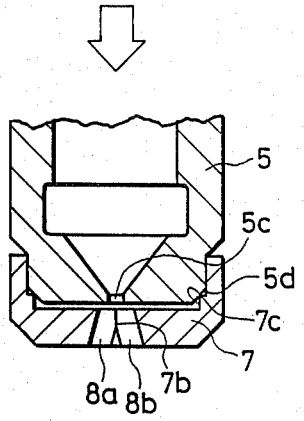
Figure 7:
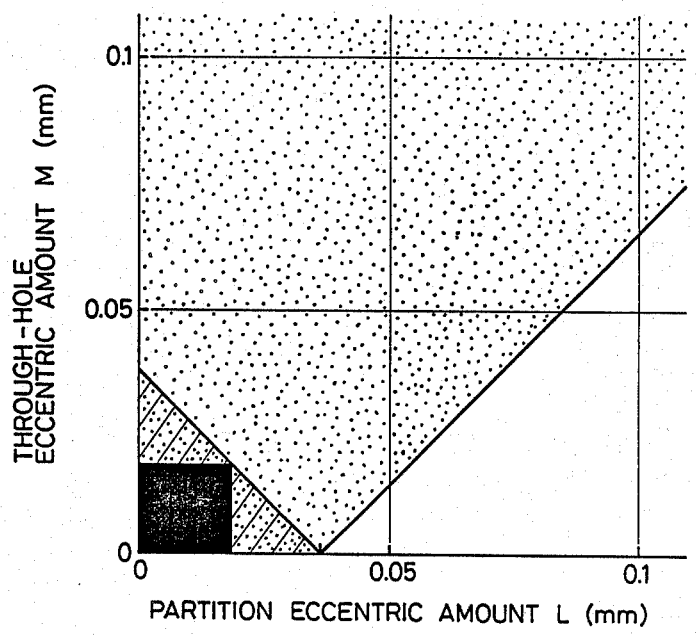
FIG. 7 is a graphic illustration for describing an allowable range of manufacturing errors according to the embodiment of the present invention.

A description will be made hereinbelow in terms of a method for assembling the valve body 5 and the nozzle 7. FIGS. 6A through 6B are illustrations useful for describing the principle of the position adjusting method for the valve body 5 and the nozzle 7. FIGS. 6A through 6C shows the relationship in position between the through-hole 5*c* of the valve body 5 and the injection holes 8*a*, 8*b* of the nozzle 7 when viewed from a direction indicated by an arrow in FIG. 6D showing the state that the nozzle 7 is coupled to the valve body 5 with the force being applied to the convexed portion 7*c* of the nozzle 7. Of these, FIGS. 6A and 6B respectively illustrate the state that the position of the injection holes 8*a*, 8*b* is slipped out relative to the through-hole 5*c*, that is, the fuel from the through-hole 5*c* is divided evenly by the injection holes 8*a* and 8*b* and FIG. 6C illustrates the state that the slippage of the injection holes 8*a*, 8*b* in position relative to the through-hole 5*c* is corrected by rotation of the nozzle 7 or the valve body 5. Therefore, the adjustment in position between the nozzle 7 and the valve body 5 can be made by relatively rotating either the nozzle 7 or the valve body 5 with the convexed portion 7*c* of the nozzle 7 and the tapered portion 5*d* of the valve body 5 being brought into contact with each other, thereby considerably enlarging the allowable range of manufacturing errors of the fuel injection valve as compared with a conventional one as shown in FIG. 7 which is a graphic illustration wherein the vertical line represents the eccentric amount M of the through-hole 5*c* from the axis and the horizontal line represents the eccentric amount L of the partition 7*d* from the axis. In the illustration, a dotted portion indicates an allowable range in the case of the adjustment in position between the valve body 5 and the nozzle 7 is effected by the rotation and a hatching portion indicates an allowable range in the case of the conventional one. A black portion represents an allowable range in connection with the manufacturing indication of the manufacturing drawings and so on. Here, in this example, only the eccentric amount L of the center partition 7*b* of the nozzle 7 and the eccentric amount M of the through-hole 5*c* are considered, and actually, it may be required to consider the angle of the injection holes 8*a*, 8*b*, and other factors such as the diameter thereof, and as a result, the black portion has an allowance which is below several micrometers. The increase of the allowable arange causes relaxation of the valve manufacturing accuracy, resulting in considerable cost reduction. The rotation of the nozzle 7 or the valve body 5 can be smoothly made because the nozzle 7 is in surface contact, i.e., stable contact, with the valve body 5 due to the flat-crushing of the edge 7*d* of the convexed portion 7*c*.

Figure 8:
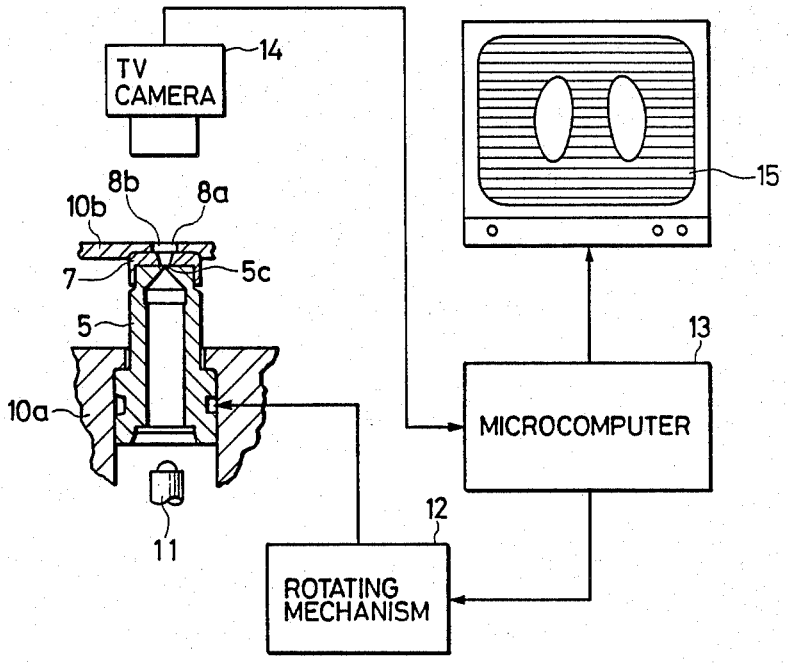
FIG. 8 schematically shows a device for performing the position adjustment of the nozzle and the valve body.

Subsequently, a detailed example of the position adjustment will be described hereinbelow with reference to FIGS. 8 through 11. FIG. 8 schematically shows a device for performing the position adjustment of the nozzle 7 and the valve body 5. In FIG. 8, the position adjusting device comprises a first holder 10*a* for fixedly holding the valve body 5 and a second holder 10*b* for fixedly holding the nozzle so that the injection holes 8*a*, 8*b* thereof are covered thereby. The first holder 10*a* is connected to a rotating mechanism 12 so that it is rotatable together with the valve body 5 under control of a microcomputer 13. The reference numeral 11 is a light source for projecting light from the upstream side of the valve body 5 to the injection holes 8*a*, 8*b* of the nozzle 7. Light transmitted through the injection holes 8*a*, 8*b* is received by a television camera (TV camera) 14 positioned at the opposite side with respect to the valve body 5. The TV camera 14 is coupled to the microcomputer 13 to produce an image signal and to supply it to an imaging apparatus (CRT) 15 where two images corresponding to the quantities of light passing through the injection holes 8*a*, 8*b* is produced on its screen.

Here, since the state that light passes through the injection holes 8*a*, 8*b* is similar to the state that fuel actually flows therethrough, the area ratio between the two images produced on the CRT screen is substantially proportional to the ratio of flow rates actually passing through the injection holes 8*a*, 8*b* that is, there is a correlation therebetween. This correlation can be obtained on the basis of the configuration of the through-hole 5*c*, the angle $\theta$ made by the injection holes 8*a*, 8*b* and so on. The microcomputer 13 investigates the position relationship between the through-hole 5*c* and the partition 7*b* on the basis of the comparison between the magnitudes of the light rays passed through the injection holes 8*a*, 8*b* with the valve body 5 being rotated by means of the rotating mechanism 12 and stops the rotation of the valve body 5 when the valve body 5 is rotated relatively to the nozzle 7 to a position where the valve body 5 and the nozzle 7 are relatively in the desirable position relationship.

Figure 9:
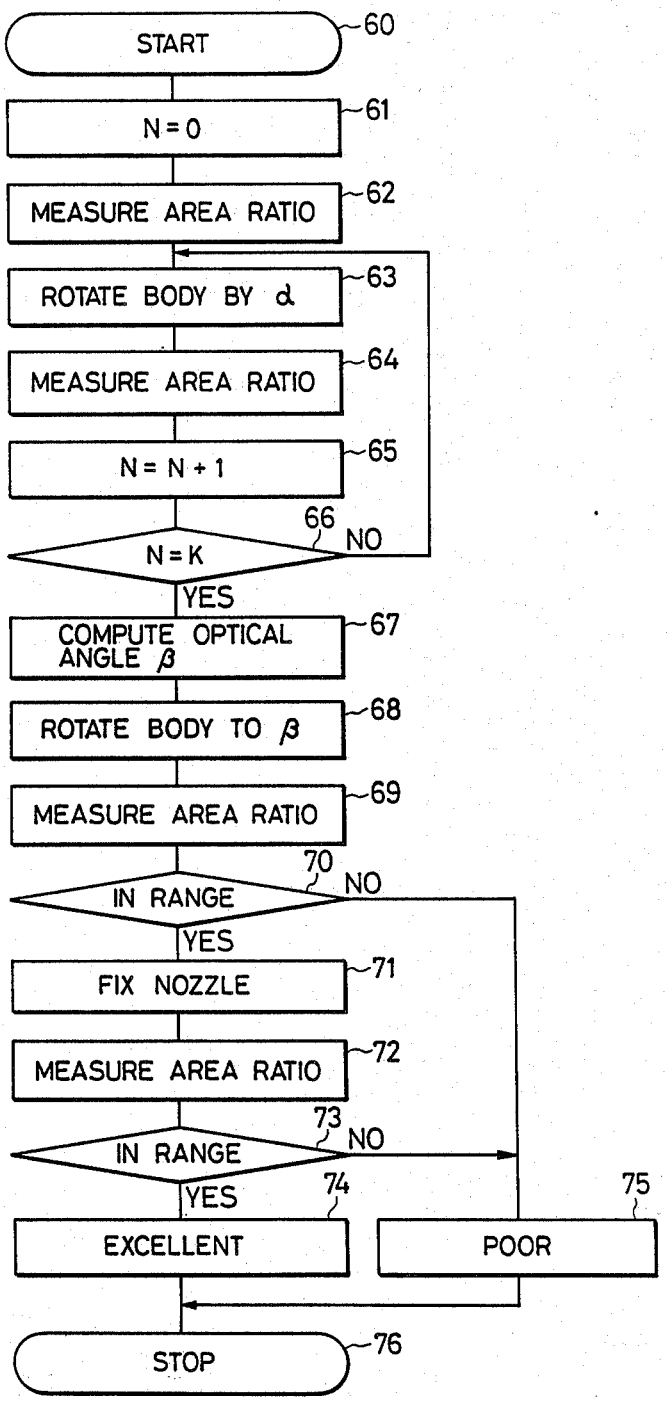
FIG. 9 is a flow chart programmed for performing the position adjusting method according to the embodiment of this invention.

FIG. 9 is a flow chart programmed for execution of the position adjusting process. This program starts with a step 60 which is in turn followed by a step 61 in which a counter N is reset to zero. A subsequent step 62 is executed to measuring the area ratio of the light rays transmitted through the injection holes 8*a* and 8*b*. Process goes to a step 63 to rotate the valve body 5 by a predetermined angle $\alpha$ (in this embodiment, $\alpha=20°$) and then to a step 64 to again measure the area ratio of the light rays. The executed number of the step 63 or 64 is counted by the counter N in a step 65 and after it is checked in a step 66 that the count value K reaches a predetermined value K (in this embodiment, K=19), that is, when the valve body 5 has been rotated through 360°, the microcomputer computes in a step 67 the optimal angle $\beta$ at which a desired area ratio (in this embodiment, 1) can be obtained, then followed by a step 68 to again rotate the valve body 5 to obtain the optimal angle $\beta$. Thereafter, in a step 69 the microcomputer again measures the area ratio of the light rays and checks whether the measured area ratio is in the allowable range in a step 70. If so, a step 71 is executed to allows the nozzle 7 to be fixed to the valve body 5. For checking that the slippage of the nozzle 7 with respect to the valve body 5 does not occur during the fixing process, a step 72 is executed to further measure the area ratio of the light rays and it is then checked in a step 73 whether the area ratio is in the allowable range. If so, control goes to a step 74 in which the fuel injection valve is treated as an excellent article. On the other hand, if not in the step 70 or 73, a step 75 is executed to handle the fuel injection valve as a poor article.

Thus, utilizing the fact that the area ratio of the passed light rays and the ratio of actual fuel flow rates are in the correlation, the nozzle 7 and the valve body 5 can be relatively positioned simply and quickly and a desirable fuel flow rate ratio can be realized without actually passing fuel through the injection holes 8*a* and 8*b*. Furthermore, even if the positions of the through-hole 5*c* and the injection holes 8*a*, 8*b* are slipped from the design values due to manufacturing errors, the ratio of flow quantities of fuel from the injection holes 8*a*, 8*b* can be set to the target value with the adjustment by the rotation of the nozzle 7 and valve body 5 at assembly.

After the position adjustment, the nozzle 7 may be fixedly secured to the valve body 5 by means of clampling or laser welding.

Figure 10:
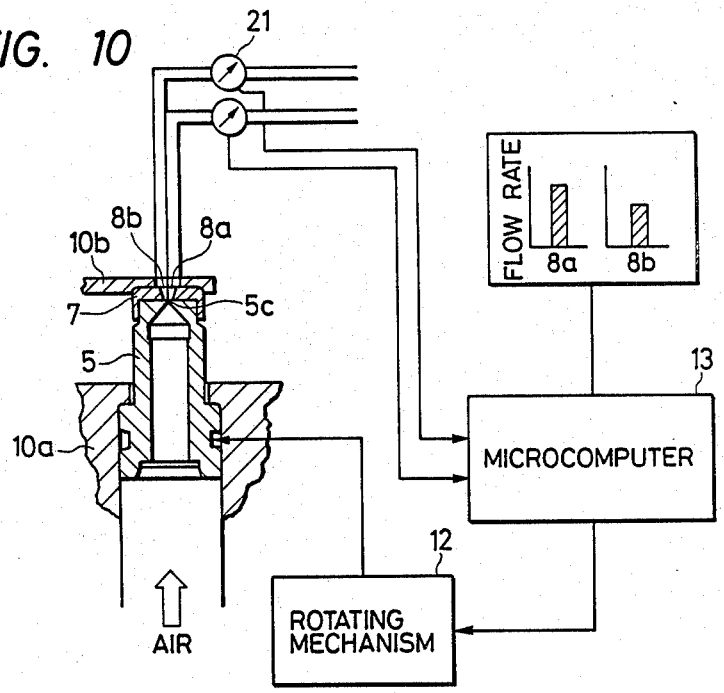
FIGS. 10 and 11 respectively show other devices for performing the position adjustment of the nozzle and the valve body.
Figure 11:
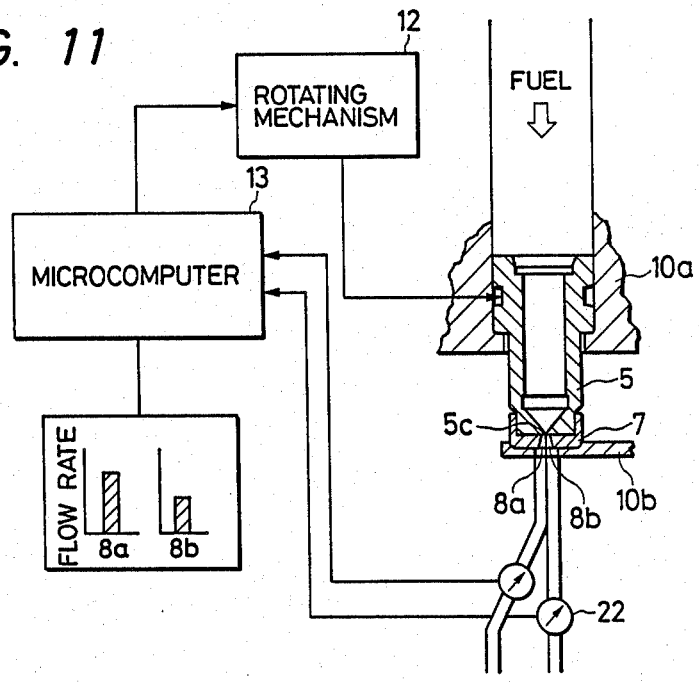

FIGS. 10 and 11 illustrate other position adjusting devices. Of these, FIG. 10 shows a position adjusting device using air flow and FIG. 11 shows a position adjusting device using fuel flow. In FIG. 10, air is supplied from the upstream side of the valve body 5 and air amounts passed through the injection holes 8*a*, 8*b* are measured by a pair of air flow meters 21 with the valve body 5 being rotated by means of a rotating mechanism 12 under control of a microcomputer 13. The flow meters 21 are respectively coupled to the microcomputer 13 to supply signals indicative of air flow information. The microcomputer stops the rotation of the valve body 5 when the ratio of flow rates from the injection holes 8*a*, 8*b* is coincident with the target ratio. In FIG. 11, fuel is used in place of the air in FIG. 10, and therefore, a pair of fuel flow meters 22 are provided for measuring the flow rates from the injection holes 8*a*, 8*b* and the signals indicative of the flow rates are supplied to a microcomputer 13 so that it is checked whether the ratio of the flow rates is coincident with the target ratio. If so, the microcomputer generates a control signal to a rotating mechanism 12 to stop the rotation of the valve body 5.

It should be understood that the foregoing relates to only preferred embodiments of the present invention, and that it is intended to cover all changes and modifications of the embodiments of the invention herein used for the purposes of the disclosure, which do not constitute departures from the spirit and scope of the invention.

What is claimed is:

1. An assembling method of a fuel injection valve for fuel injection into an internal combustion engine which includes a cylindrical valve body having a fuel passage therein and a through-hole made in a direction of the axis thereof, a needle provided in said fuel passage of said valve body for controlling a flow rate of fuel from said fuel passage by opening and closing said through-hole, and a cylindrical nozzle coupled to said valve body so that said through-hole is covered from the outside of said valve body, said nozzle having a plurality of injection holes for dividing the fuel exited from said through-hole into a plurality of parts and for injecting the divided fuel parts into said engine, comprising the steps of:

(a) coupling said nozzle to said valve body;

(b) rotating said valve body realtive to said nozzle; and (c) stopping the rotation of said valve body when said through-hole takes a desirable position relative to said injection holes and fixedly securing said nozzle to said valve body.

2. An assembling method as claimed in claim 1, further comprising the step of projecting light from the upstream side of said through-hole with said valve body being rotated relative to said nozzle, and wherein said valve body is stopped when the ratio of amounts of light rays passed through said injection holes assumes a predetemined value.

3. An assembling method as claimed in claim 1, further comprising the step of supplying air from the upstream side of said through-hole with said valve body being rotated relative to said nozzle, and wherein said valve body is stopped when the ratio of flow rates of air streams passed through said injection holes assumes a predetermined value.

4. An assembling method as claimed in claim 1, wherein an end portion of said valve body is tapered conically and said nozzle has at least one edge portion at its inside so that said edge portion comes into contact with said tapered portion when said nozzle is coupled to said valve body, said edge portion being made of a material which is deformed non-elastically in response to application of a force, and the step (a) comprises a step of deforming said edge portion by pressing said edge portion to said tapered portion when said nozzle is coupled to said valve body.

5. An assembling method of a fuel injection valve for fuel injection into an internal combustion engine which includes a cylindrical valve body having a fuel passage therein and a through-hole made in a direction of the axis thereof, a needle provided in said fuel passage of said valve body for controlling a flow rate of fuel from said fuel passage by opening and closing said through-hole, and a cylindrical nozzle coupled to said valve body so that said through-hole is covered from the outside of said valve body, said nozzle having a plurality of injection holes for dividing the fuel exited from said through-hole into a plurality of parts and for injecting the divided fuel parts into said engine, comprising the steps of:

(a) coupling said nozzle to said valve body;

(b) projecting light from the upstream side of said through-hole;

(c) rotating said valve body realtive to said nozzle at intervals of a predetermined angle;

(d) stopping the rotation of said valve body whenever said valve body is rotated by said predetermined angle and measuring the ratio of amounts of the light rays passed through said injection holes;

(e) determining an optimum angle of the rotation angles at which the relation in position between said through-hole and said injection holes becomes desired when said valve body is rotated through 360°;

(f) further rotating said valve body to said optimum angle; and (g) fixedly securing said nozzle to said body after reaching said optimum angle.

6. An assembling method as claimed in claim 5, wherein an end portion of said valve body is tapered conically and said nozzle has at least one edge portion at its inside so that said edge portion comes into contact with said tapered portion when said nozzle is coupled to said valve body, said edge portion being made of a material which is deformed non-elastically in response to application of a force, and the step (a) comprises a step of deforming said edge portion by pressing said edge portion to said tapered portion when said nozzle is coupled to said valve body.

* * * * *